US005120068A

United States Patent [19]

Tablan

[11] Patent Number: 5,120,068

[45] Date of Patent: Jun. 9, 1992

[54] DOMINO WITH FOLDING PORTIONS TO CHANGE INDICIA

[76] Inventor: Antonio Tablan, 3350 McKinley Pkwy., Blasdell, N.Y. 14219

[21] Appl. No.: 570,807

[22] Filed: Aug. 22, 1990

[51] Int. Cl.[5] ..... A63F 9/20

[52] U.S. Cl. ..... 273/293; 273/155; 273/159; 446/487

[58] Field of Search ..... 273/153 S, 155, 159, 273/292, 293, 296; 283/99, 106; 493/959; 40/526, 529, 530; 446/147, 487, 488, 490

[56] References Cited

U.S. PATENT DOCUMENTS

| | | | |
|---|---|---|---|
| 2,253,823 | 8/1941 | Suteras | 273/293 |
| 2,807,471 | 9/1957 | Moore | 273/155 |
| 2,873,976 | 2/1959 | Alatorre | 273/293 |
| 3,053,537 | 9/1962 | Moss | 273/293 |
| 3,566,483 | 3/1971 | Axelrod | 273/293 |
| 4,327,516 | 5/1982 | Lubozynski | 493/959 X |
| 5,016,889 | 5/1991 | Moss et al. | 273/293 |

OTHER PUBLICATIONS

"Mathematical Games", Scientific American, vol. 224, No. 5, May 1971, pp. 110, 111, 112, 114, 116.

*Primary Examiner*—William H. Grieb
*Assistant Examiner*—William M. Pierce
*Attorney, Agent, or Firm*—Larson and Taylor

[57] ABSTRACT

A domino game is provided wherein some of the domino pieces have rotatable or convertible end sections that thus permit player a choice as the symbol to be displayed when the game piece is played. Symbols are displayed on both sides of each game piece, and the game pieces having rotatable or convertible ends can be changed to display alternative symbols, thereby adding to the challenge and complexity of the game. Preferably, the symbols comprise representations of U.S. or foreign currency or coins, with each game piece displaying both the front and back of at least one denomination. In one embodiment, the convertible game pieces comprise relatively rotatable sections. In an alternative embodiment, the game pieces have end sections that may be pivoted or flipped over, rather than rotated, to display different symbols. In another embodiment, each game piece comprises two separate sections which may be mated together in various orientations.

4 Claims, 8 Drawing Sheets

DOMINO WITH FOLDING PORTIONS TO CHANGE INDICIA

FIELD OF THE INVENTION

The present invention relates to the field of games, and in particular to a domino-type game having convertible, e.g., reversible or rotatable, pieces.

BACKGROUND OF THE INVENTION

Numerous domino-type games have existed for centuries. The typical domino game consists of a set of flat rectangular blocks having faces divided into two equal parts which are blank or have one to six dots arranged as on a dice face.

Prior patented modifications to the domino game pieces have all retained the rigid structure of the domino piece while modifying only the manner in which symbols are displayed. For instance, U.S. Pat. No. 4,257,611 (Schmitz, Sr.) discloses a domino piece with concealable dots while British patent No. 8436 discloses domino pieces wherein the dot surfaces are recessed so to prevent wear. Further, U.S. Pat. No. 2,253,823 (Suteras) discloses a domino piece wherein the traditional dots are replaced with recessed and rotatable disks bearing numbers rather than dots. In each of these patents the domino pieces are rigid, and the symbols are displayed on only one side.

The traditional domino game is designed primarily for entertainment only and not for educational purposes. Modifications of the domino game to achieve such an educational purpose include those disclosed in French Patent No. 916,213 (Emanoylidis) wherein flags of different countries are used rather than dots, and U.S. Pat. No. 2,782,039 (Martin) wherein various combinations of numbers are used rather than dots to aid the players in learning mathematics.

Other patents of possible interest include U.S. Pat. No. 812,676 (Paul) and U.S. Pat. No. 927,183 (Staley) both of which disclose card games wherein the cards include U.S. currency denominations thereon.

SUMMARY OF THE INVENTION

In accordance With the invention, games pieces for a domino-type game are provided which substantially enhance the complexity and challenge of the game as compared with the conventional game of dominos as well as other prior art domino-type games such as discussed above. A further important aspect of the invention concerns the provision, in accordance with a preferred embodiment, of game pieces which educate the players as to the tokens of monetary exchange of a country or government by using replicas, facsimiles or other representations of the tokens of that country as the symbols to be matched. Considering the coins of the United States as an example, symbols corresponding to the penny, nickel, dime, quarter, half dollar and dollar are preferably used as symbols to be matched so that a young person or a person new to the United States becomes familiar with the coins as the game is played. Because as noted above and discussed in more detail below, a very important aspect of the invention concerns the provision of games pieces wherein the symbol displayed can be changed or reversed, the fact that the construction of some of the game pieces permits an obverse or "heads" coin symbol of that game piece to be converted to, i.e., replaced by, reverse or "tails" coin symbol, and vice versa, significantly adds to the amount of information regarding the coins that can be imparted and substantially enhances the appeal of the game.

In accordance with one aspect of the invention, an assembly of game pieces for a domino-like game is provided wherein symbols at the ends of the game pieces are matched in the playing of the game, the assembly comprising at least one game piece having opposite ends and comprising a first symbol on at least one end thereof on a least one side thereof which is displayed in one orientation of said game piece, and mechanical means for enabling the symbol displayed on said one side to be changed to a different symbol.

According to one preferred embodiment of the invention which is very inexpensive to manufacture the "convertible" game pieces are substantially flat and made of cardboard, sturdy paper, or other inexpensive flexible or foldable materials. In this embodiment, the mechanical means comprises a hinged section of the game piece carrying the "different" symbol (e.g., a "head" representation) on one face thereof and pivotally connected at the one end of the game piece so that pivoting of the hinged section into a position wherein the hinged section overlies an adjacent section of the game piece on which the first symbol (e.g., a "tail" representation) is displayed causes the different symbol to be displayed, thereby permitting the player to match the different symbol to a like symbol of another game piece in playing the game.

Preferably, the game piece of this embodiment comprises hinged sections on both ends thereof. Advantageously, the game piece comprises also means for detachably securing the hinged section in place in the aforementioned position as well as in a position wherein the hinged section underlies the adjacent section so that first symbol (the symbol on the adjacent section) is displayed.

In a preferred implementation, the securing means comprises a pair of simple tabs formed in the body of the game piece. As noted previously, the symbols on the game pieces are, in accordance with an important embodiment, representations of the two sided tokens of monetary exchange and the first symbol and different symbol represent opposite side of the same token of monetary exchange.

In accordance with a further preferred embodiment of the invention, the convertible game pieces each comprises first and second relatively rotatable sections, with the first section being disposed at the one end of the game piece and carrying the two symbols on opposite sides thereof and the mechanical means comprising means for enabling rotation of the first section so as to enable either of the symbols to be displayed, thereby enabling a player to match either symbol to that on another game piece.

In this embodiment, the mechanical means preferably comprises a pin or rod, extending from the second section into the first section, about which the first section rotates. In one advantageous implementation of this mechanical means the pin or rod is disposed in aligned chambers of the first and second sections and interconnects these sections, and also includes means, e.g., flanges at end of the pin, which limit axial movement. In addition, a spring means is provided for biasing the sections together.

Regardless of the manner in which some of the game pieces are made convertible, a preferred embodiment of the game piece assembly of the invention further comprises at least one fixed game piece have a symbol in the center thereof between the opposite ends thereof. In addition, the game piece assembly preferably further comprises at least one game piece having a blank symbol at one end thereof and a non-blank symbol at the opposite end thereof. Advantageously, the assembly comprises a plurality of different sets of game pieces including a set of different game pieces each having a representation of a different token of monetary exchange at the center thereof, a set of different game pieces wherein each game piece has a representation of a different token of monetary exchange from the other game pieces and has the same token representation at opposite ends thereof, a set of different game pieces each having a representation of a different token of monetary exchange at one end thereof and a blank at the other end thereof, a set of different game pieces comprising all of the possible combination of pairs of the token representations at opposite ends thereof, and a game piece having blanks at opposite ends thereof.

According to another embodiment of the invention, each game piece is comprised of one substantially rectangular sheet of foldable material folded in half and joined at the ends thus forming a top and bottom half. The game piece is foldable along the joined end and also foldable at the midpoint of both the top and bottom halves such that four substantially square sections are defined on which symbols are located. In use, the game piece sections are folded simultaneously along opposing fold lines so to switch the adjacent symbols on the top and bottom sections.

In another alternate embodiment each game piece comprises two substantially flat sections and includes mating means for enabling the two sections to be removably mated together so that the two sections can be separated, rotated with respect to each other and remated, to thereby display a different combination of symbols on each side of the game piece. Also, the individual sections of each game piece may be mated to the individual sections of other game pieces.

BRIEF DESCRIPTION OF THE DRAWINGS

FIGS. 3(*c*) and 3(*b*) are top and bottom plan views, respectively, of a set of game pieces corresponding to that of FIGS. 3(*a*) and 3(*b*);

DETAILED DESCRIPTION OF THE PREFERRED EMBODIMENTS

Figure 1:
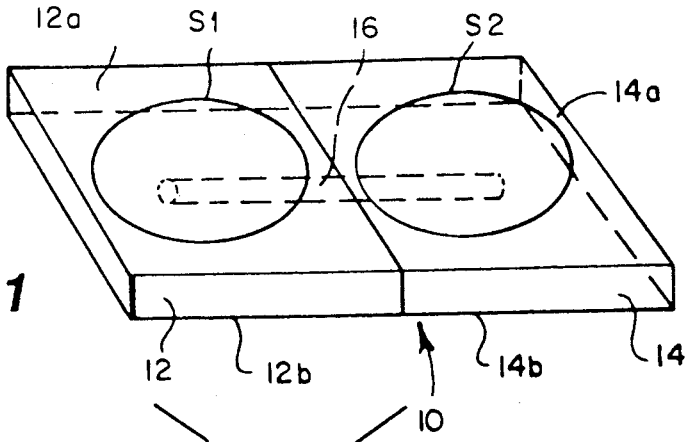
FIG. 1 is a perspective view of a game piece in accordance with a first embodiment of the invention.

Referring to FIG. 1, a first preferred embodiment of a game piece in accordance with the present invention is shown. The game or domino piece, which is generally denoted 10, is flat and substantially rectangular and comprises two rectangular (preferably square) sections 12 and 14 connected together by an internal rod, pin or nail 16 so to allow the two sections 12 and 14 to be manually rotated about the axis defined by the rod 16. In the illustrated embodiment, rod 16 extends from one edge of section 14 through that section into section 12, as shown.

The opposite faces or sides 12*a* and 12*b* of section 12 and the opposite sides or faces 14*a* and 14*b* of section 14 have provided thereon a symbol, such as traditional domino dots, or preferably, as mentioned above and discussed in more detail below, representations of U.S. or foreign currency or coins. Such symbols are generally indicated as S1 on face 12*a* and as S2 on face 12*b*. It will, of course, be appreciated that any type of symbol may be utilized, and numerous variations on the traditional domino game may be developed in accordance with this invention. It will also be understood that one or more of the symbols can simply be a "blank", i.e., all sections of all pieces need not include a representation symbol. The representations of U.S. monetary tokens of exchange provided in accordance with a preferred embodiment can be of coins or paper money or any tangible representation of international currency. Further, current or historic versions of currency can be used in either accurate or fanciful forms or representations. In a preferred embodiment described below, each section 12 or 14 of some of the domino pieces, corresponding to piece 10, display or contain thereon, in accordance with an advantageous embodiment, the obverse, or "heads", side of a coin on one side of that section and the reverse, or "tails", side of a coin on the opposing side of the same square. Thus, it will be appreciated that, for example, by simply rotating section 14 from the position shown in FIG. 1 so that the symbol, e.g., a heads, on side 14*b* is on the top, i.e., is displayed, and the symbol e.g., a tails on side 14*a* is on the bottom, a player can change the displayed symbol from a tails to heads and vice versa.

Figure 2:
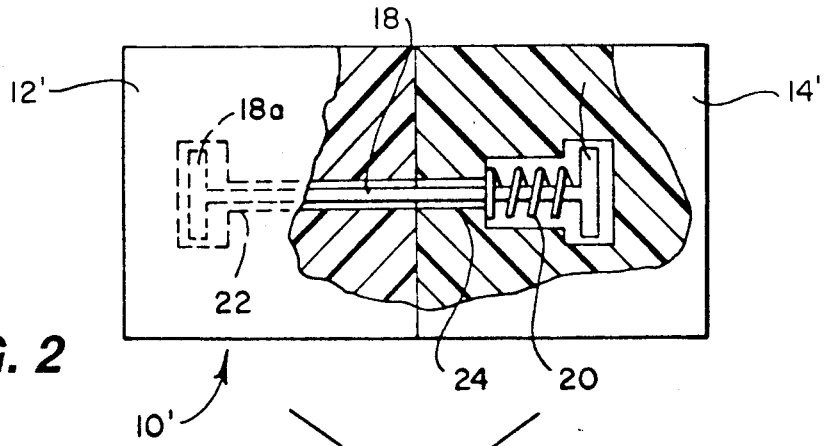
FIG. 2 is a top plan view, partially broken away, of a game piece in accordance with a second, related embodiment.

Referring to FIG. 2, an alternative embodiment of the invention is shown. The embodiment of FIG. 2 is similar to that of FIG. 1 and like elements have been given the same reference numerals with primes attached. The difference between the embodiment of FIG. 2 and that of FIG. 1 is that, in FIG. 2, the two sections 12' and 14' of the game piece 10' are connected together by an elongate connector member 18 having transversely extending retaining or holding portions 18*a* and 18*b* at opposite ends thereof, and a coil spring 20 which surrounds a part of connector member 18 adjacent to the retaining portion 18*b*. Connector member 18 and spring 20 are housed within internal chambers 22 and 24 formed in sections 12' and 14' and are shaped to match those portions of connector 18 enclosed thereby, with chamber 24 being enlarged in the area of spring 20 to accommodate that spring. Spring 20 is precompressed prior to the insertion thereof into chamber 24 and thus exerts a biasing force which biases the sections 12' and 14' together so that the sections must be pulled apart slightly prior to rotation. Sections 12' and 14' are each preferably of a two part construction comprising matching upper and lower halves so as to permit the connector member 18 to be inserted into, e.g., the lower half and the upper half to then be secured to lower half.

Turning now to a consideration of a preferred embodiment of the game of the invention, a complete set of game pieces comprising an educational game utilizing representations of U.S. coins is shown in FIGS. 3–11. It should be appreciated that, as noted above, foreign or historic currency may be substituted where appropriate or a combination of U.S. and foreign coins may be used together in one game. In the preferred embodiment under consideration, eight sets of game pieces are used, as shown in FIGS. 3–11.

As shown in FIGS. 3(*a*) and 3(*b*), the game pieces of the first set comprises a solid piece 30 having a symbol or representation of a symbol of a U.S. coin, in this case, a one cent piece or penny, denoted 32*a*, at the center of each face. As illustrated in FIG. 3 (*a*), the obverse, or "heads", side of the coin is displayed on one side of the domino piece 30 while, as illustrated in FIG. 3 (*b*), the reverse, or "tails", side of the coin, denoted 32*b*, is represented on the opposite side of the domino piece 30. Preferably, for educational purposes, the symbols used closely correspond to the actual coins, as shown in FIGS. 3 (*a*) and 3 (*b*), although simplified or stylized symbols are used throughout the remainder of the drawing figures for purposes of simplicity.

The complete group of game pieces of the first set is illustrated in FIGS. 3 (*c*) and 3 (*d*) wherein FIG. 3 (*c*) shows the obverse faces of six pieces $\mathbf{30}_1$ to $\mathbf{30}_6$ corresponding to those of FIG. 3 (*a*) and representing one dollar, a half dollar, a quarter, a dime, a nickel and penny, respectively. Similarly, FIG. 3 (*d*) shows the obverse faces of the six pieces $\mathbf{30}_1$ to $\mathbf{30}_6$. The game pieces of this first set are not rotatable and are constructed in accordance with traditional domino pieces except that the symbol is displayed in the middle on each side.

Figure 4A:
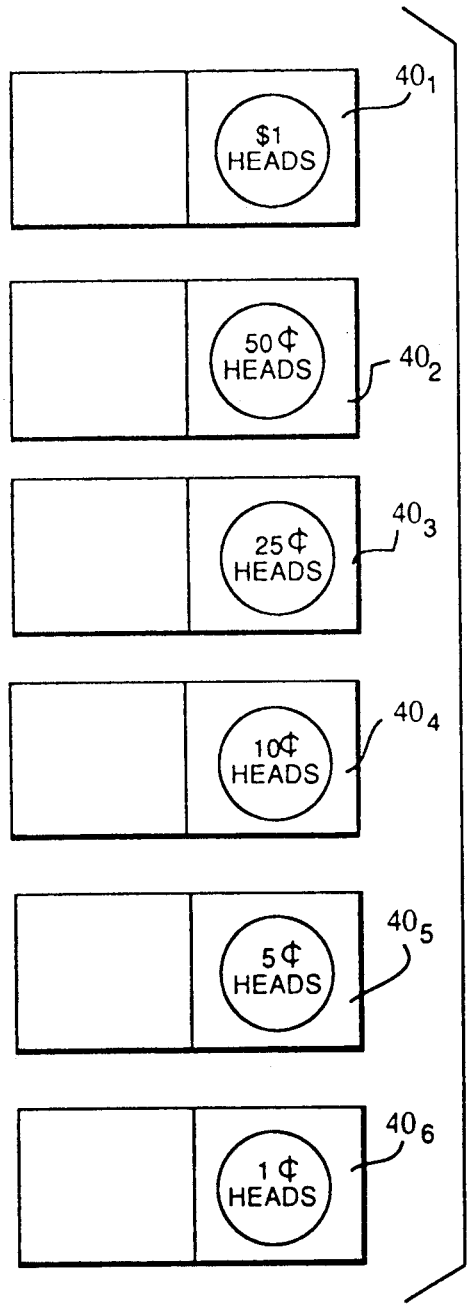
FIGS. 4(*a*) and 4(*b*) are top and bottom plan view, respectively, of a further set of game pieces.
Figure 4B:
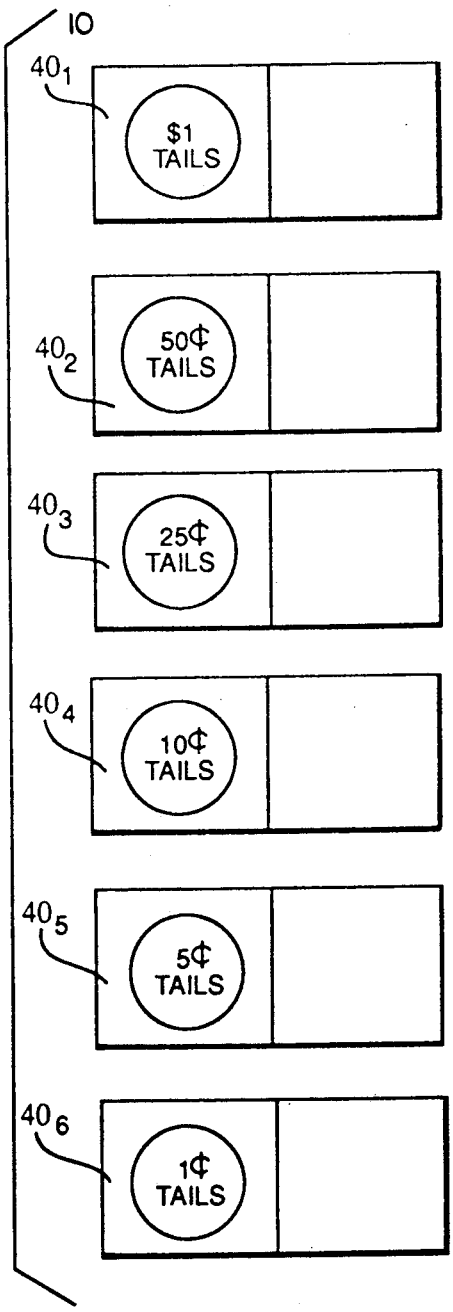

A second set of six domino pieces denoted $\mathbf{40}_1$ to $\mathbf{40}_6$, shown in FIGS. 4(*a*) and 4 (*b*), each displaying a representation of a U.S. coin at one end thereof piece on both the obverse side (FIG. 4 (*a*)) and the reverse side (FIG. 4 (*b*)). The same sequence of U.S. coins are used as described above. The game pieces of the second set of are likewise rigid and neither rotatable nor reversible.

Figure 5A:
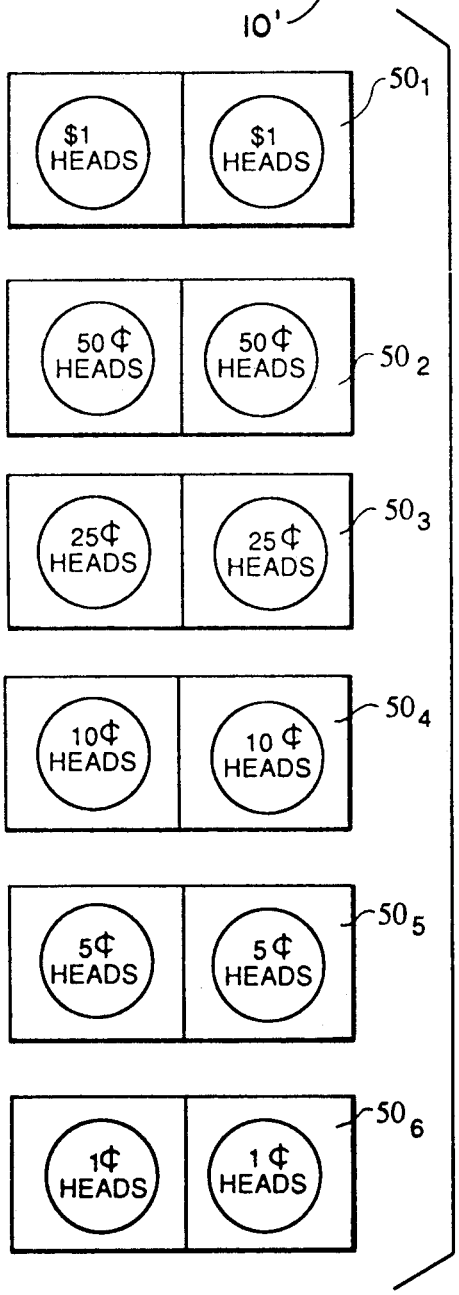
FIGS. 5(*a*) and 5(*b*) are top and bottom plan view, respectively, of a further set of game pieces.
Figure 5B:
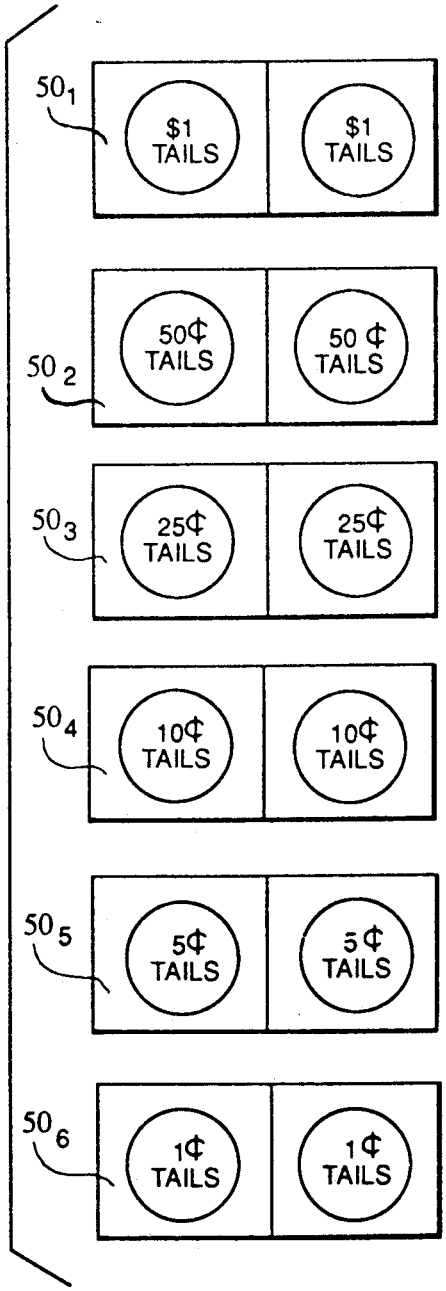
Figure 3A:
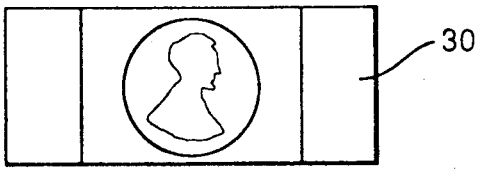
FIG. 3(*a*) and 3(*b*) are top and bottom plan views, respectively, of a further game piece.
Figure 3B:
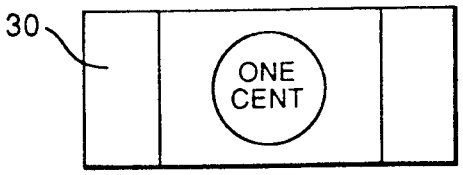
Figure 3C:
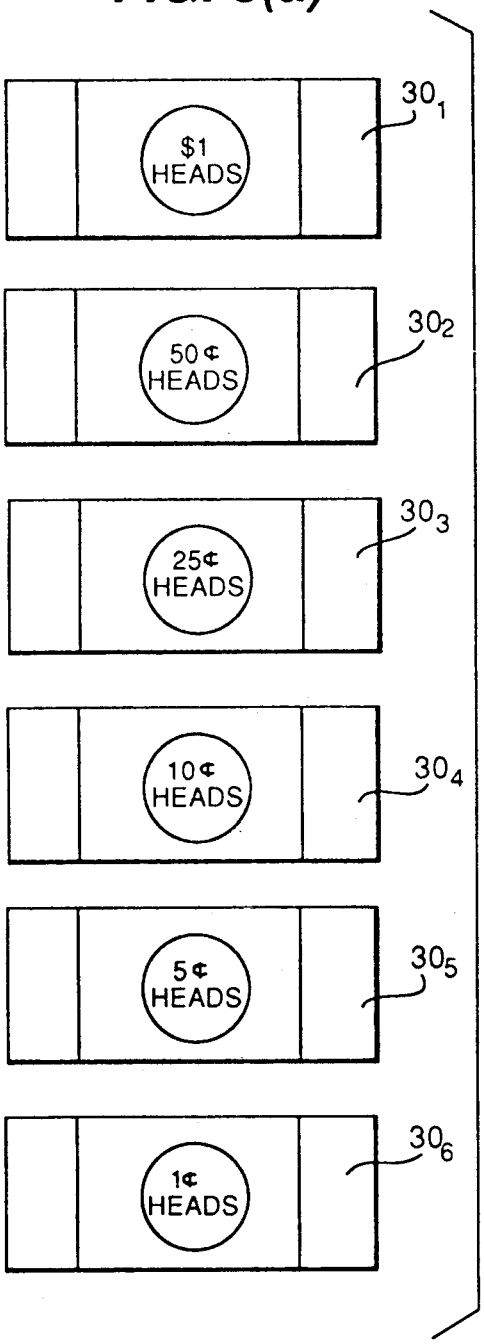
Figure 3D:
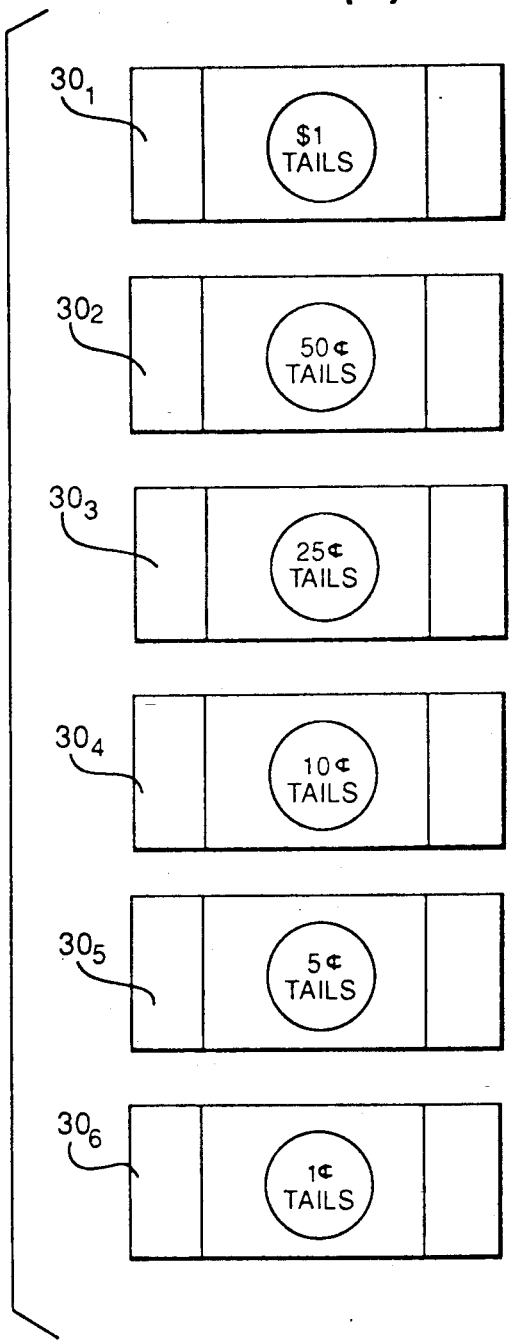

Referring to FIGS. 5 (*a*) and 5 (*b*), the obverse (heads) and reverse (tails) side of a further set of dominos or game pieces $\mathbf{50}_1$ to $\mathbf{50}_6$ are shown. These game pieces are of the type shown, e.g., in FIGS. 1 and 2, and each face or side include two symbols thereof on separate sections thereof as described above in connection with FIGS. 1 and 2. Thus, considering game piece $\mathbf{50}_2$ as an example, it is possible to rotate either section so that e.g., a "head" is replaced by a "tail" as the displayed symbol at either end.

Figure 6A:
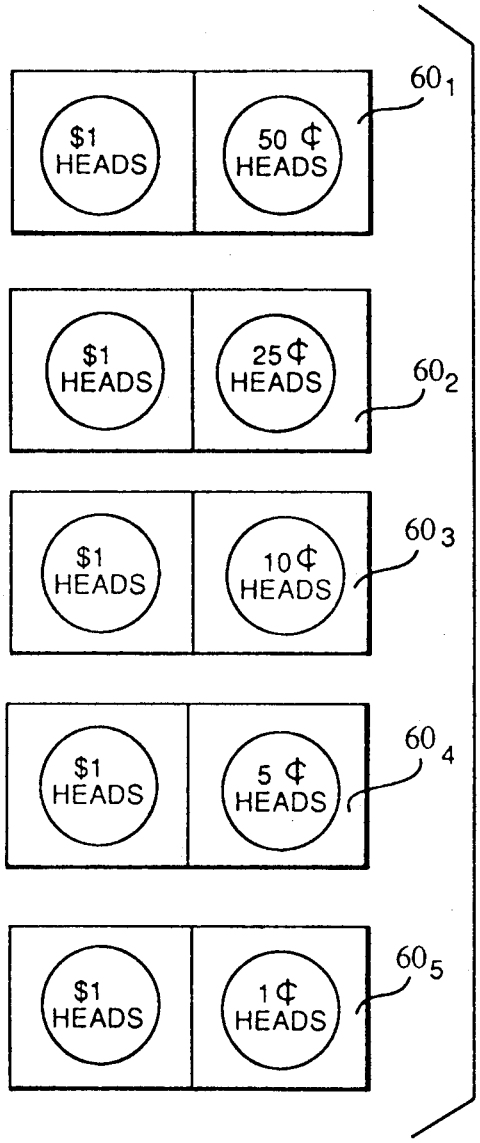
FIGS. 6(*a*) and 6(*b*) are top and bottom plan view, respectively, of a further set of game pieces.
Figure 6B:
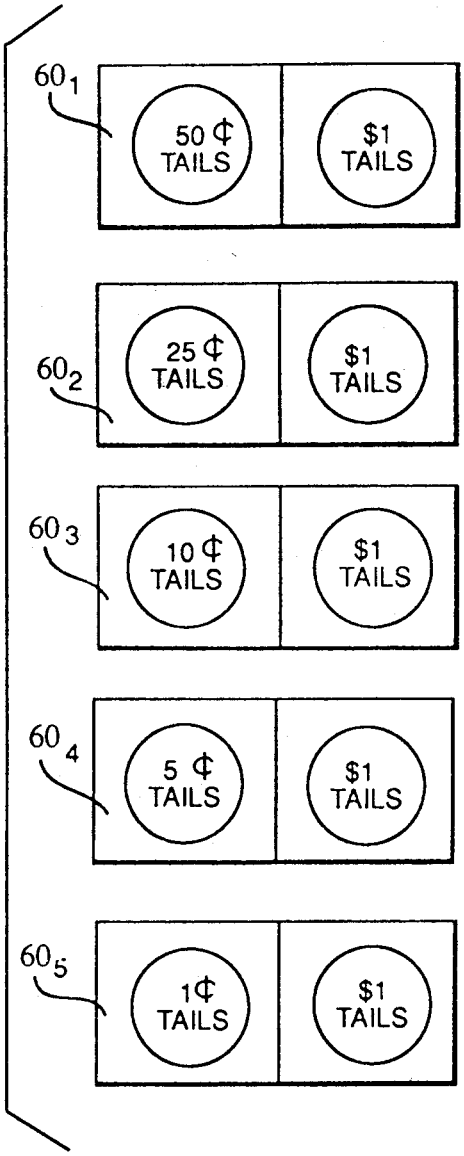

FIGS. 6 (*a*) and 6 (*b*) illustrate a further set of game pieces $\mathbf{60}_1$ and $\mathbf{60}_6$ wherein different coin symbols are combined, as shown. Each of these game pieces are also reversible as described above in connection with FIGS. 1 and 2.

Figure 7A:
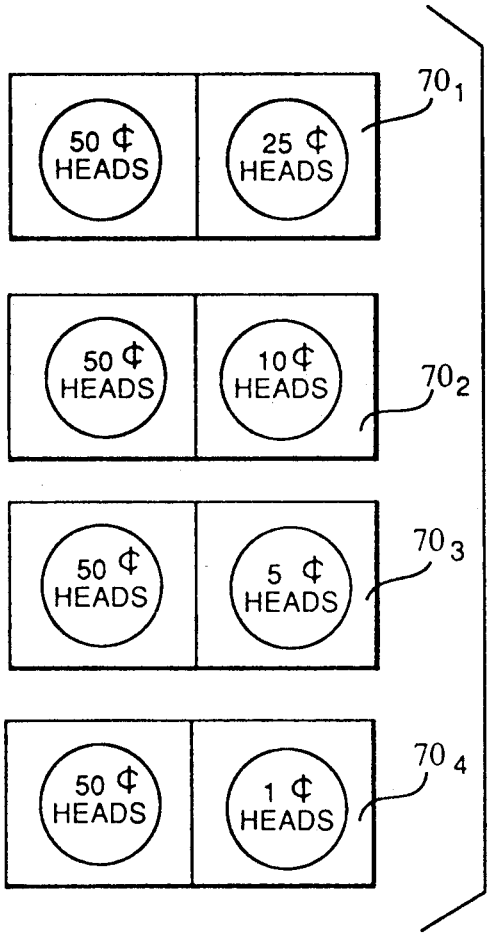
FIGS. 7(*a*) and 7(*b*) are top and bottom plan view, respectively, of a further set of game pieces.
Figure 7B:
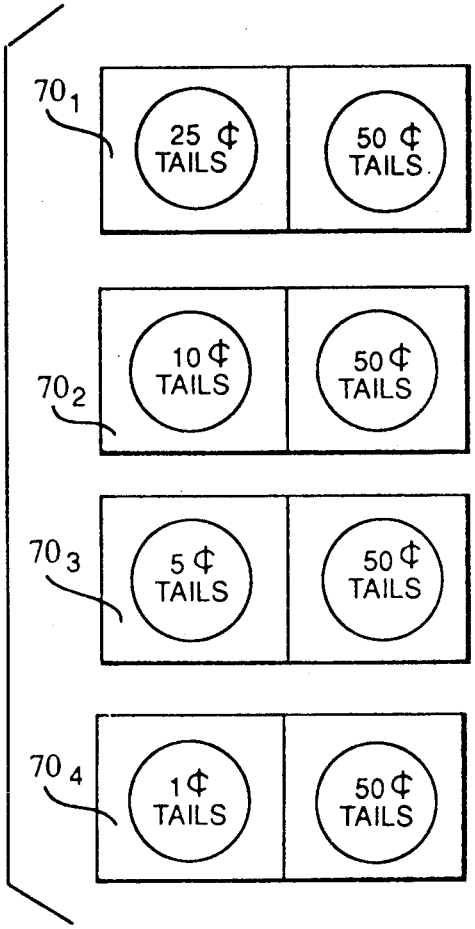
Figure 8A:
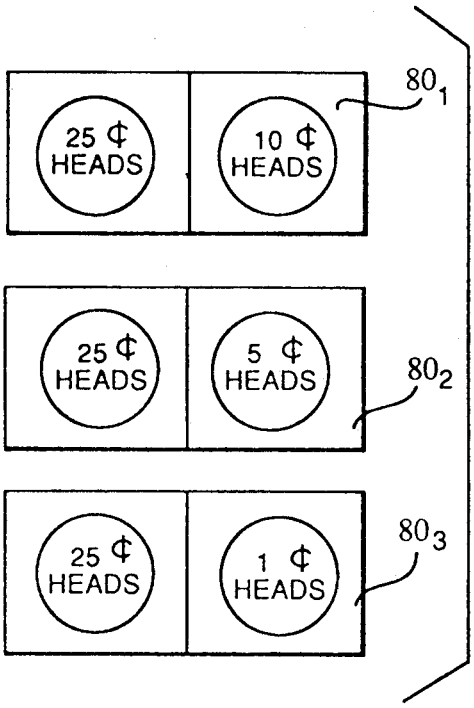
FIGS. 8(*a*) and 8(*b*) are top and bottom plan view, respectively, of a further set of game pieces.
Figure 8B:
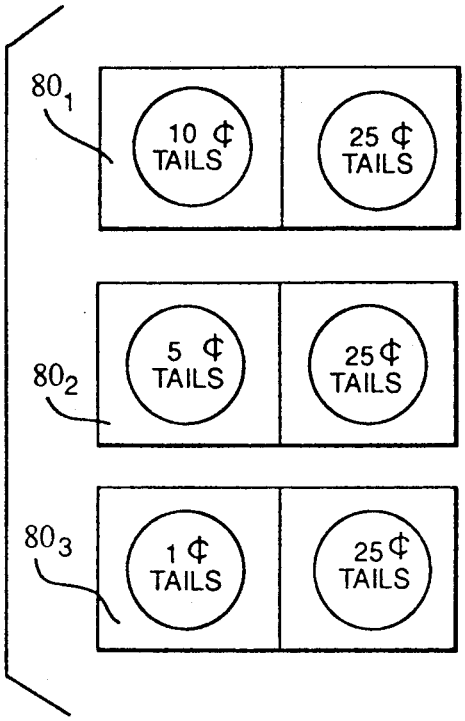
Figure 9A:
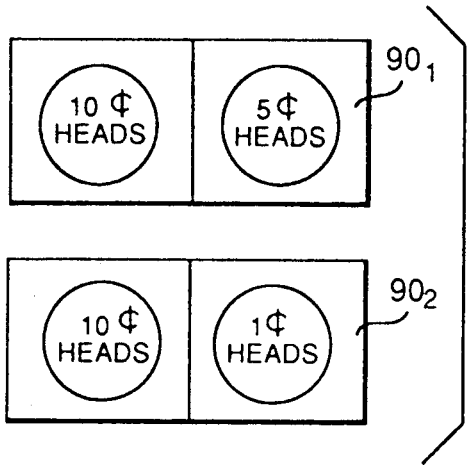
FIGS. 9(*a*) and 9(*b*) are top and bottom plan view, respectively, of a further set of game pieces.
Figure 9B:
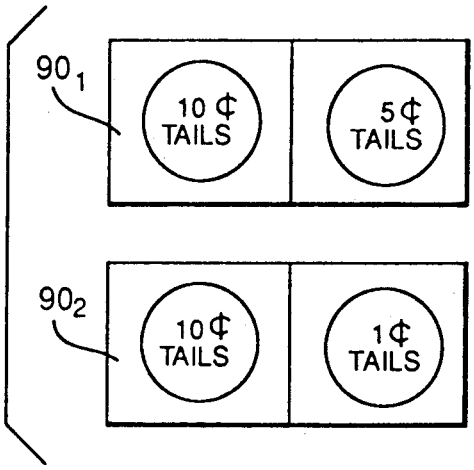
Figure 10A:
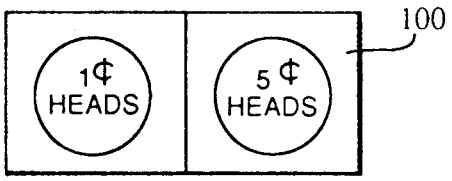
FIGS. 10(*a*) and 10(*b*) are top and bottom plan views, respectively, of a further game piece.
Figure 10B:
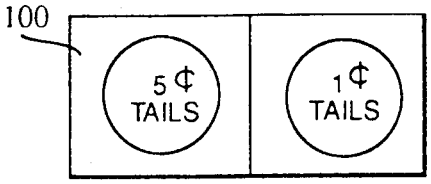
Figure 11A:
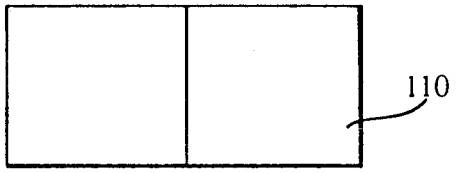
FIGS. 11(*a*) and 11(*b*) are top and bottom plan views, respectively, of a further game piece.
Figure 11B:
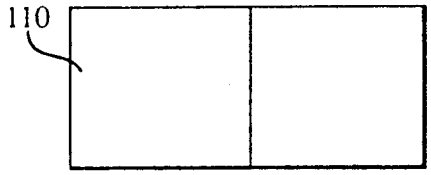

FIGS. 7 (*a*) and 7 (*b*) show further games pieces $\mathbf{70}_1$ to $\mathbf{70}_4$, FIGS. 8 (*a*) and 8 (*b*) show further game pieces $\mathbf{80}_1$ to $\mathbf{80}_3$, FIGS. 9 (*a*) and 9 (*b*) show further game pieces $\mathbf{90}_1$ and $\mathbf{90}_2$ and FIGS. 10 (*a*) and (*b*) show a further game piece 100, all including different combinations of coin symbols as illustrated. FIGS. 11 (*a*) and (*b*) show the final game piece, a single non-rotatable piece 110 with no coin represented on either side and referred to as the "joker."

Play proceeds according to the traditional rules of dominos with some modifications. Prior to play, the pieces are shuffled in a bag, each player is provided with a rack or racks to organize his or her set of domino pieces and to prevent other players from seeing the pieces. One important feature of the game is that, as described above, with the game pieces that are reversible the players can, at their option, reverse the orientation of a section of the rotatable domino pieces so as to change the "displayed" symbol and thereby to facilitate play by e.g., enabling a player to match a "tail" symbol with a corresponding "tail" symbol of another game piece. Further, the fact that the pieces, apart from "joker" 110, carry symbols on both sides adds to the complexity and enjoyment of the play. In addition, the provision of game pieces such as shown in FIGS. 3 (*c*) and 3 (*d*) (as well as in FIGS. 3 (*a*) and 3 (*b*)) wherein the symbol is in the middle also adds a level of complexity in that the game rules forbid the use of such piece in matching a further game piece having the same symbols at both ends. For example, if a first player would play the heads side of game piece $\mathbf{50}_4$ (two dimes or ten cent representation) this piece cannot be matched directly by piece $\mathbf{30}_4$ but can be matched by one end of piece game piece $\mathbf{40}_4$.

In all embodiments described thus far, it is preferred that the domino pieces be constructed of durable material such as wood, plastic, metal or the like.

Figure 13:
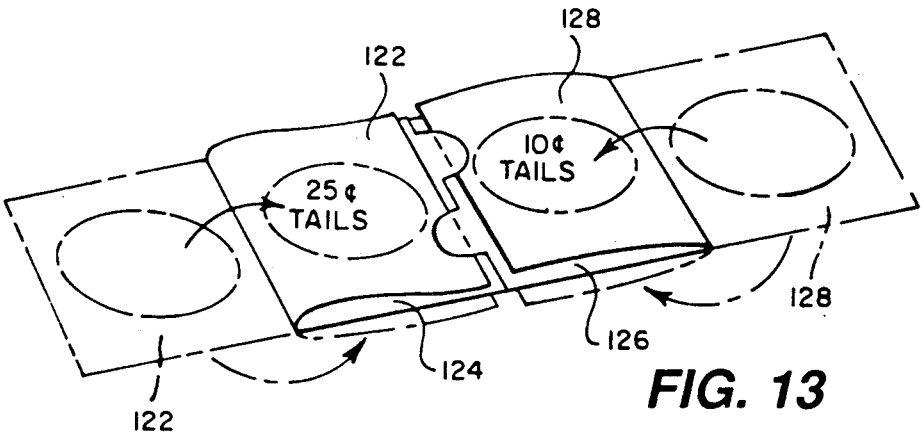
FIG. 13 is a perspective view of the game piece of FIGS. 12(*a*) and 12(*b*)
Figure 12A:
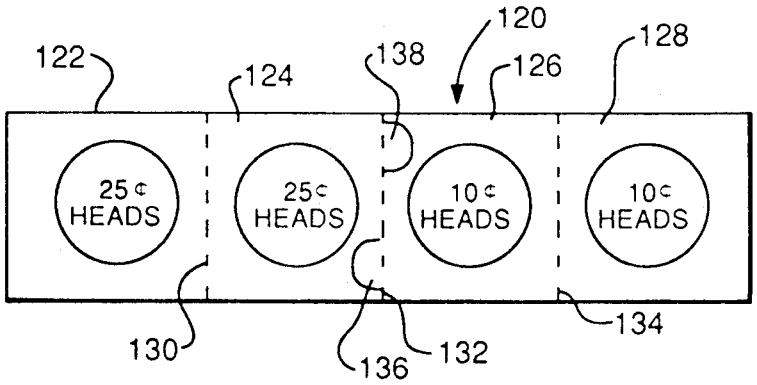
FIGS. 12(*a*) and 12(*b*) are top and bottom plan views, respectively, of a "convertible" game piece in accordance with yet a further embodiment of the invention.
Figure 12B:
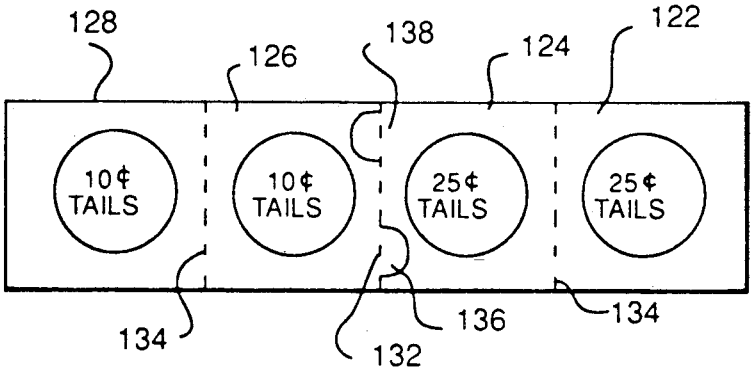

Referring to FIGS. 12 (*a*), 12 (*b*) and 13, an alternate embodiment of the present invention is shown wherein the game pieces are basically two dimensional and wherein end sections are foldable rather than rotatable in order to change or convert the displayed symbol. More particularly, game piece 120 is substantially rectangular and preferably constructed from sturdy paper or cardboard. Each side of the game piece comprises at least four co-linear square sections of substantially equal sizes, denoted 122, 124, 126 and 128 wherein sections 122 and 128 are located at the ends of the game piece 120 and sections 124 and 126 are located adjacent to the center of the games piece. Sections 122 and 124 are divided or separated by a fold line 130, sections 124 and 126 are divided or separated by a center line 132, and sections 126 and 128 are divided or separated by a fold line 134. The game piece is adapted to be folded along fold lines 130 and 134, and, for example, as indicated in FIG. 13, end section 122 can be folded with respect to center section 124 along line 130 such that end section 122 is disposed either adjacent to the top surface of the center section 124 or adjacent to the bottom surface of center section 124. Likewise, end section 128 can be similarly folded as is also indicated in FIG. 13. When so folded, the end section 122 and 128 may be secured in place relative to the respect to the center sections 124 and 126 by means of tabs 136 and 138. Tabs 136 and 138 each comprise a semi-circular member formed in the base material of game piece 128 adjacent to center line 132 with the two tabs extending in opposite directions, as shown. Each tab 136 and 138 is adapted to be folded along center line 132 so to protrude at a slight angle above either the top surface or the bottom surface of center section 124 and 126. In this manner, the tabs 136 and 138 are adapted to secure or fix end sections 122 and 128 in place when the end sections are folded as described above. Therefore, this alternate embodiment allows, in use, four possible combinations of symbols to be displayed by the game piece, viz, for the example illustrated, "25¢ heads"/"10¢ heads", "25¢ heads"/"10¢ tails", "25¢ tails"/"10¢ heads" and "25¢ tails"/"10¢ tails", depending on the direction of the folding of the end sections.

Figure 14:
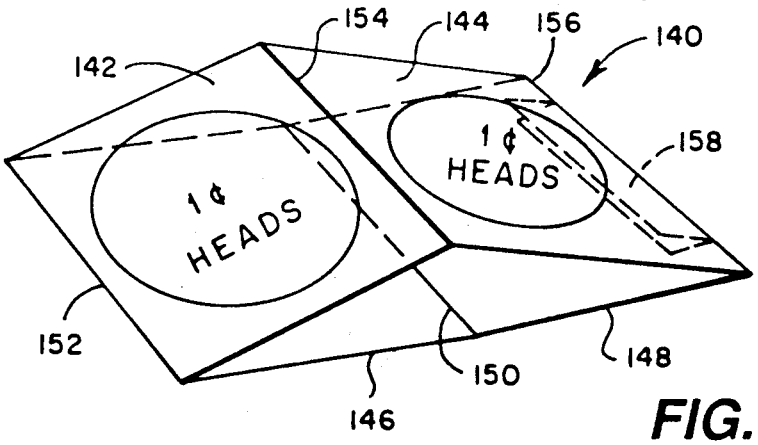
FIG. 14 is a perspective view of a "convertible" game piece in accordance with yet a further embodiment of the invention.
Figure 15:
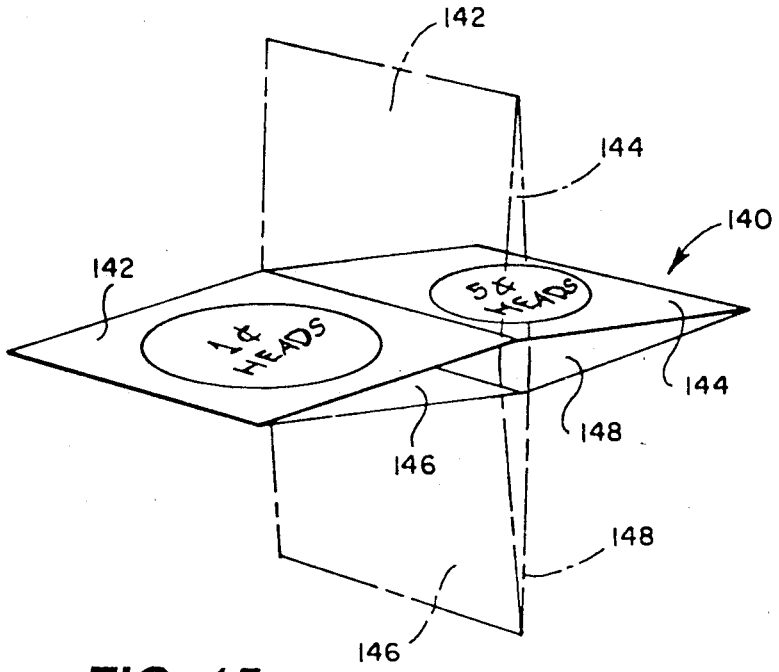
FIG. 15 is a further perspective view of the game piece of FIG. 14, showing a different configuration thereof.

Referring to FIGS. 14 and 15, another alternative embodiment of the present invention is shown wherein each game piece comprises two rectangular sections joined at the ends and foldable at the ends and centers. More particularly, the game piece, denoted 140, which is preferably constructed from one rectangular piece of sturdy paper or cardboard, on each side thereof at least two square sections of substantially equal size. The two sections forming the top of the game piece 140 are denoted 142 and 144, whereas the two sections forming the bottom of the game piece are denoted 146 and 148. Top sections 142 and 144 are joined along a fold line 154 and bottom sections 146 and 148 are joined along a fold line 150. Also, top section 142 and bottom section 146 are joined along a fold line 152, and top section 144 and bottom section 148 are joined along a fold line 156. Top section 144 and bottom section 148 are permanently joined along line 156. This can be accomplished, as shown in FIGS. 14 and 15 with an adhesive strip, 158, attached to and joining the outward ends of top section 144 and bottom section 148. However, any suitable attachment means may be used so long as top section 144 and bottom section 148 are securely attached together and yet may be folded along line 156.

In use, the game piece 140 may be simultaneously folded along fold lines 150, 152, 154 and 156 from a first orientation, shown in solid lines FIG. 15, to a second orientation, shown by dashed lines in FIG. 15. In the first orientation, sections 142 and 144 form the top of the game piece, 140, and sections 146 and 148 form the bottom side of the game piece. In the second orientation, sections 142 and 146 are disposed adjacent and form the top side of the game piece, 140, and sections 144 and 148 are disposed adjacent and form the bottom side of the game piece, 140. In this manner, for example, the top symbols, "1¢ heads" and "5¢ heads" may be switched to "5¢ heads" and "5¢ tails" while the bottom symbols are simultaneously switched to "1¢ heads" and "1¢ tails", respectively.

In play, either the top or bottom of the game piece 140 may be placed face up. Therefore, four possible combinations of symbols are available to be matched with other game pieces during play of the game. Although this embodiment has been described as constructed of sturdy paper or cardboard foldable along line 152, 154 and 156 and joined with an adhesive strip 158 along line 156, any suitable material may be used to form the game piece sections, including plastic, wood or metal, and, as noted, any suitable means may be used to form the foldable joints such as a hinge.

Figure 16:
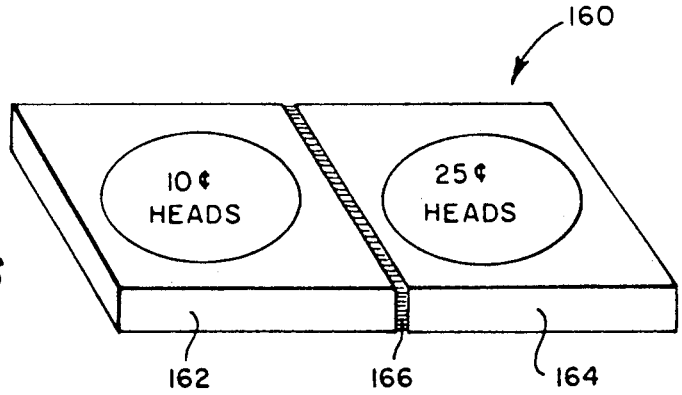
FIG. 16 is a perspective view of a "convertible" game piece in accordance with yet another embodiment of the invention.
Figure 17:
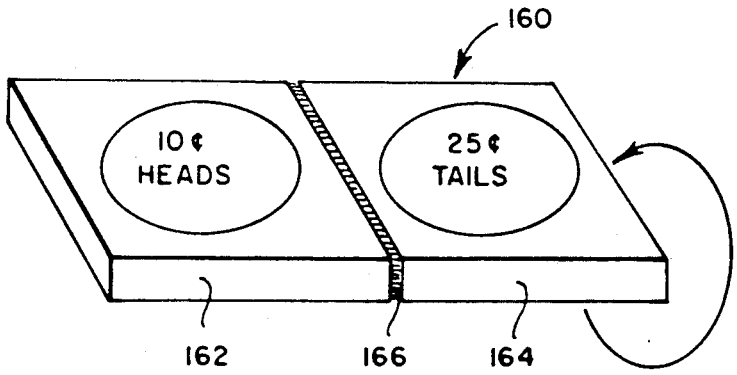
FIG. 17 is a further perspective view of the game piece of FIG. 16, showing a different configuration of the sections thereof.

Referring to FIGS. 16 and 17, another alternative embodiment of the present invention is shown wherein the game piece comprises two separate sections that may be mated together in various combinations and orientations. More particularly, a game piece 160, which is substantially rectangular and preferably constructed from wood, plastic or metal, comprises two substantially square flat sections 162 and 164. Symbols can be displayed on both sides of each section. The two sections 162 and 164 are temporarily mated together along at least one of their edges, by a suitable mating means 166. The mating means 166 can, for example, be formed by hooks and loops ("VELCRO") surfaces indicated schematically in FIG. 17 (or by any other suitable means such as a rod or pin attachment arrangement or by using magnets incorporated within the two sections) so that the two sections 162 and 164 can be easily attached or separated during the course of the game.

In use, adjacent symbols on one side of the game piece 160 can be switched by separating sections 162 and 164, rotating section 164, and thus re-securing section 164 to section 162 via the mating means 166. Therefore, to yield the orientation shown in FIG. 1, each game piece 160 can display four different combinations of symbols for matching with other game symbols. For instance, considering the embodiment of FIGS. 16 and 17, the game piece 160 can display for possible matching with other game pieces, either "10¢ heads/25¢ heads", "10¢ tails/25¢ tails", "10¢ heads/25¢ tails" or "10¢ tails/25¢ tails." Alternately, a section of one game piece may be mated with a section from another game piece to increase the number of possible combinations of symbols available for play.

Finally, the game of the present invention could also be implemented in software for play on computers and the like.

Although the invention has been described with respect to exemplary embodiments thereof, it will be understood by those skilled in the art that variations and modifications can be effected in these exemplary embodiments without departing from the scope and spirit of the invention.

I claim:

1. An assembly of game pieces for a domino-like game wherein the game pieces have ends and opposite sides and symbols at the ends of the game pieces are matched in the playing of the game, said assembly comprising at least one game piece having opposite ends and comprising a first symbol on at least one end thereof on at least one side thereof which is displayed in one orientation of said game piece and mechanical means for enabling the symbol displayed on said one side to be changed to a different symbol, said game piece comprising first, second, third and fourth substantially flat sections disposed in end to end relation, and said mechanical means comprising hinge means, comprising a first hinge connecting said first and second sections, a second hinge connecting said second and third sections, a third hinge connecting said third and fourth sections and a fourth hinge connecting said fourth and first sections, for enabling said game piece to fold along said hinges between a first position wherein said first and second sections together define a top side of said game piece and said third and fourth sections together define a bottom side of said game piece, and a second position wherein said second and third sections together define a top side of said game piece and said first and fourth sections together define a bottom side of said game piece.

2. The assembly of game pieces claimed in claim 1 wherein said assembly further comprises at least one game piece having a blank symbol at one end thereof and a non-blank symbol at the opposite end thereof.

3. The assembly of game pieces claimed in claim 1 wherein said assembly comprises a plurality of game pieces carrying symbols, wherein said symbols comprise either representations of two sided tokens of monetary exchange or blanks, and wherein the opposite sides of each of said game pieces carrying symbols thereon represent opposite sides of the same token of monetary exchange.

4. An assembly of game pieces claimed in claim 1 wherein said fourth hinge means comprises a strip of adhesive tape.

* * * * *